US008045746B2

(12) United States Patent
Takayama et al.

(10) Patent No.: US 8,045,746 B2
(45) Date of Patent: Oct. 25, 2011

(54) SPEAKER DEVICE

(75) Inventors: Koji Takayama, Yamagata (JP); Kazuki Yuze, Yamagata (JP); Hiroyuki Kobayashi, Yamagata (JP); Shinichi Hayasaka, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 1305 days.

(21) Appl. No.: 11/644,997

(22) Filed: Dec. 26, 2006

(65) Prior Publication Data

US 2007/0154057 A1 Jul. 5, 2007

(30) Foreign Application Priority Data

Dec. 26, 2005 (JP) ..... 2005-373234

(51) Int. Cl.
*H04R 1/00* (2006.01)
*H04R 9/06* (2006.01)
*H04R 11/02* (2006.01)

(52) U.S. Cl. ..... 381/398; 381/396; 381/400; 381/407

(58) Field of Classification Search ..... 381/423, 381/424, 426, 396, 398, 403–404, 407
See application file for complete search history.

(56) References Cited

U.S. PATENT DOCUMENTS 6,118,884 A * 9/2000 Proni ..... 381/403
2004/0112672 A1* 6/2004 Ono et al. ..... 181/169
2005/0253298 A1 11/2005 Takayama et al.

FOREIGN PATENT DOCUMENTS

| | | | |
|---|---|---|---|
| JP | 10-210593 A | | 8/1998 |
| JP | 2001-218295 A | | 8/2001 |
| JP | 2001218295 A | * | 8/2001 |
| JP | 2002-271892 A | | 9/2002 |
| JP | 2005-328309 A | | 11/2005 |

* cited by examiner

*Primary Examiner* — Davetta Goins
*Assistant Examiner* — Matthew Eason
(74) *Attorney, Agent, or Firm* — Arent Fox LLP

(57) ABSTRACT

It is an object of the present invention to use a simplified structure to improve a strength of a neck portion of a conical diaphragm in the vicinity of a voice coil fixing section, thereby inhibiting an undesired dividing vibration in a speaker device. The speaker device of the present invention comprises: a generally conical diaphragm having an opening formed in a generally central position thereof; a voice coil bobbin fixed in the inner circumferential portion of the foregoing opening of the diaphragm; and a diaphragm reinforcing annular member disposed near a fixing section fixing together the diaphragm and the voice coil bobbin. The annular member includes, in the form of an integrally formed body, a diaphragm reinforcing portion having an inclined surface which contacts an inclined surface of the diaphragm close to the inner circumferential portion thereof and is fixed to the inclined surface of the diaphragm by virtue of an adhesive agent, and a cylindrical portion having a liquid holding portion which is formed between the voice coil bobbin and the annular member and is filled with the adhesive agent.

4 Claims, 15 Drawing Sheets

SPEAKER DEVICE

BACKGROUND OF THE INVENTION

The present invention relates to a speaker device.

The present application claims priority from Japanese Application No. 2005-373234, the disclosure of which is incorporated herein by reference.

A conventional speaker device comprises: a magnetic circuit containing a permanent magnet; a voice coil freely vibratably disposed within a magnetic gap of the magnetic circuit; a voice coil bobbin wound around by the voice coil; and a conical diaphragm fixed to the voice coil bobbin. When the speaker device is required to generate a large sound pressure, an electric signal having a relatively high level will be caused to flow into the voice coil through a terminal section. At this time, a driving force will be applied to the voice coil bobbin through the voice coil, thereby causing a vibration of a conical diaphragm connected with the voice coil bobbin. As a result, such a driving force will greatly act on a fixing section combining together the voice coil bobbin and the conical diaphragm. Accordingly, if the fixing section does not have an adequate strength, an adhesion exfoliation would occur and thus the fixing section could be broken. Moreover, if a strength is low in a neck portion near the central position of the conical diaphragm, an undesired dividing vibration will occur in the diaphragm, resulting in a deteriorated sound quality in a reproduced sound. To solve this problem, there has been suggested an improved speaker device having an improved strength in the neck portion of a speaker diaphragm. For example, Japanese Unexamined Patent Application Publication No. (Hei) 10-210593 has suggested that an engaging portion formed in the neck portion of the diaphragm be inserted into a slit formed along the circumference of the voice coil bobbin, thereby improving a strength of the neck portion of the diaphragm.

On the other hand, in a conventional speaker device, a notch is formed in the vicinity of a fixing section fixing together the voice coil bobbin and the conical diaphragm, particularly in the neck portion of the diaphragm, while a lead wire is led out from the voice coil through the notch. However, the formation of the notch in the neck portion of the diaphragm could reduce the strength of a part of the diaphragm near the notch. Moreover, when a notch is formed, a distortion could occur in the diaphragm, causing a deterioration in the sound quality of a reproduced sound. Besides, when the foregoing notch is formed, the diaphragm is likely to be broken, making it technically difficult to perform a processing for forming a notch in an injection molded PP (polypropylene) diaphragm or an aramid-containing diaphragm. In addition, with regard to the above-discussed conventional speaker device, it is also technically difficult to perform a processing for forming an engaging portion in the neck portion of a conical PP diaphragm or the like.

SUMMARY OF THE INVENTION

The present invention makes it one of its tasks to solve the above problem and it is an object of the present invention to use a simplified structure to improve a strength of a neck portion of a conical diaphragm in the vicinity of a voice coil fixing section, thereby inhibiting an undesired dividing vibration.

In order to achieve the foregoing object, the present invention is characterized by at least the following aspects.

According to the present invention, there is provided a speaker device comprising: a generally conical diaphragm having an opening formed in a generally central position of the diaphragm; a voice coil bobbin fixed in an inner circumferential portion of the opening of the diaphragm; and a diaphragm reinforcing annular member disposed near a fixing section fixing together the diaphragm and the voice coil bobbin. In particular, the annular member includes, in the form of an integrally formed body, a diaphragm reinforcing portion having an inclined surface which contacts an inclined surface of the diaphragm close to the inner circumferential portion thereof and is fixed to the inclined surface of the diaphragm by virtue of an adhesive agent, and a cylindrical portion having a liquid holding portion which is formed between the voice coil bobbin and the annular member and is filled with the adhesive agent.

BRIEF DESCRIPTION OF THE DRAWINGS

These and other objects and advantages of the present invention will become clear from the following description with reference to the accompanying drawings, wherein:

FIG. 3 provides views showing a top plate of the speaker device 100 illustrate in FIG. 1 and FIG. 2.

FIG. 4 provides view showing an annular reinforcing member for use in the speaker device illustrated in FIG. 1.

FIG. 13 provides views showing a process for assembling together the diaphragm and the annular member.

FIG. 14 provides explanatory views showing a detailed example of a process for assembling the vibrating system illustrated in FIG. 13.

DETAILED DESCRIPTION OF THE PREFERRED EMBODIMENTS

A speaker device formed according to one embodiment of the present invention comprises: a generally conical diaphragm having an opening formed in a generally central position of the diaphragm; a voice coil bobbin fixed in the inner circumferential portion of the foregoing opening of the diaphragm; and a diaphragm reinforcing annular member disposed near a fixing section fixing together the diaphragm and the voice coil bobbin. The annular member includes, in the form of an integrally molded body, a diaphragm reinforcing portion having an inclined surface which faces an inclined surface of the diaphragm close to the inner circumferential portion thereof and is fixed to the inclined surface of the diaphragm by virtue of an adhesive agent, and a cylindrical portion having a liquid holding portion which is formed between the voice coil bobbin and the annular member and is filled with the adhesive agent.

In the speaker device having the above-described structure, the annular member includes, in the form of an integrally molded body, a diaphragm reinforcing portion having an inclined surface which faces an inclined surface of the diaphragm close to the inner circumferential portion thereof and is fixed to the inclined surface of the diaphragm by virtue of an adhesive agent, and a cylindrical portion having a liquid holding portion which is formed between the voice coil bobbin and the annular member and is filled with the adhesive agent. In this way, it is possible for the speaker device of the present invention to ensure a higher strength than a conventional speaker device in an area (corresponding to a neck portion of the diaphragm) near the fixing portion fixing together the generally conical diaphragm and the voice coil, using the above-described simple structure. In this way, since it is possible for the speaker device of the present invention to ensure a relatively high strength in an area near the neck portion of the diaphragm, it becomes possible to reduce an undesired dividing vibration in the diaphragm. Moreover, even if the speaker device of the present invention adopts an injection molded diaphragm, it is still possible to improve the strength of the neck portion using the above-described simple structure.

In the following, description will be given to explain a speaker device formed according to one embodiment of the present invention.

Figure 1:
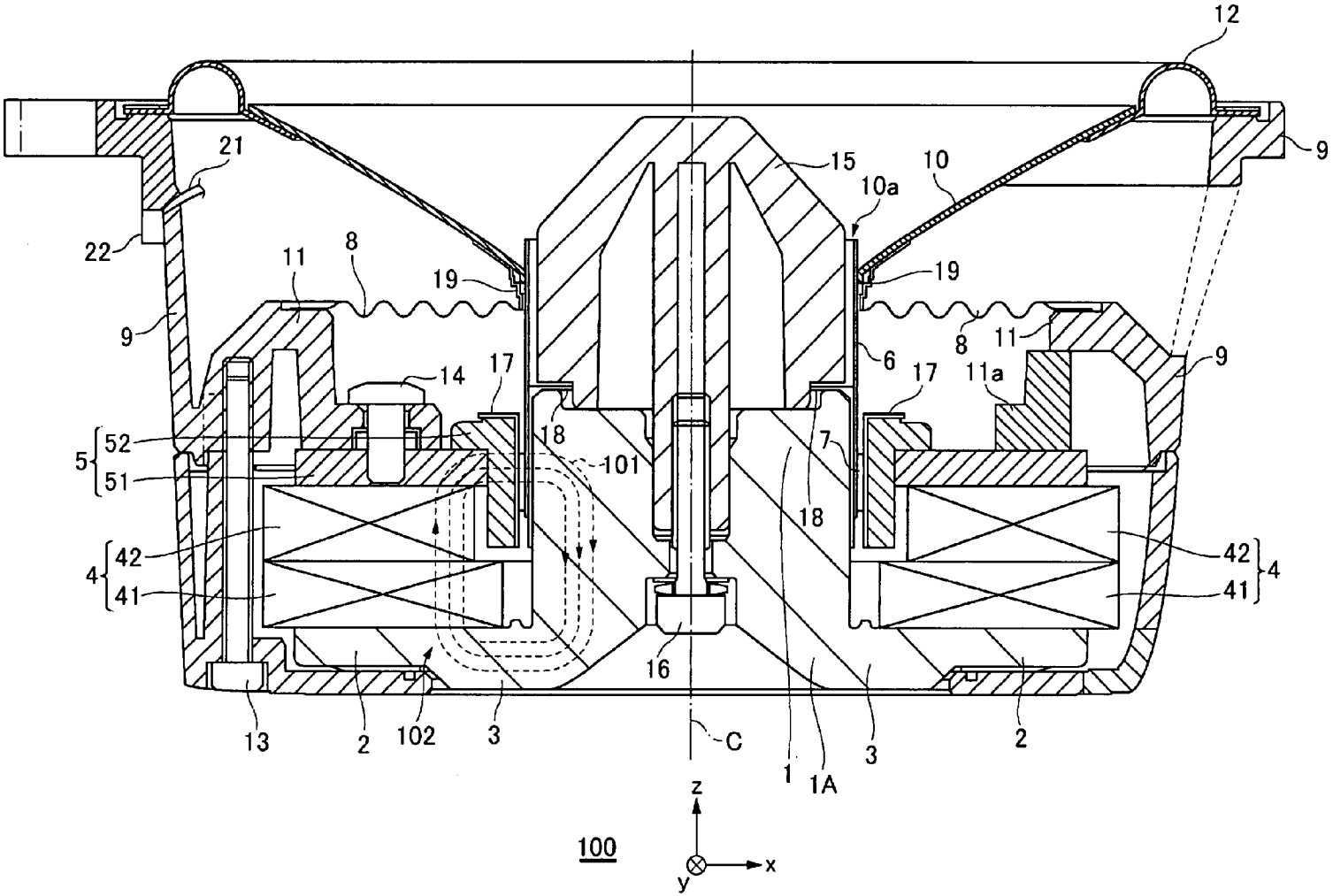
FIG. 1 is across sectional view showing a speaker device formed according to one embodiment of the present invention.
Figure 2:
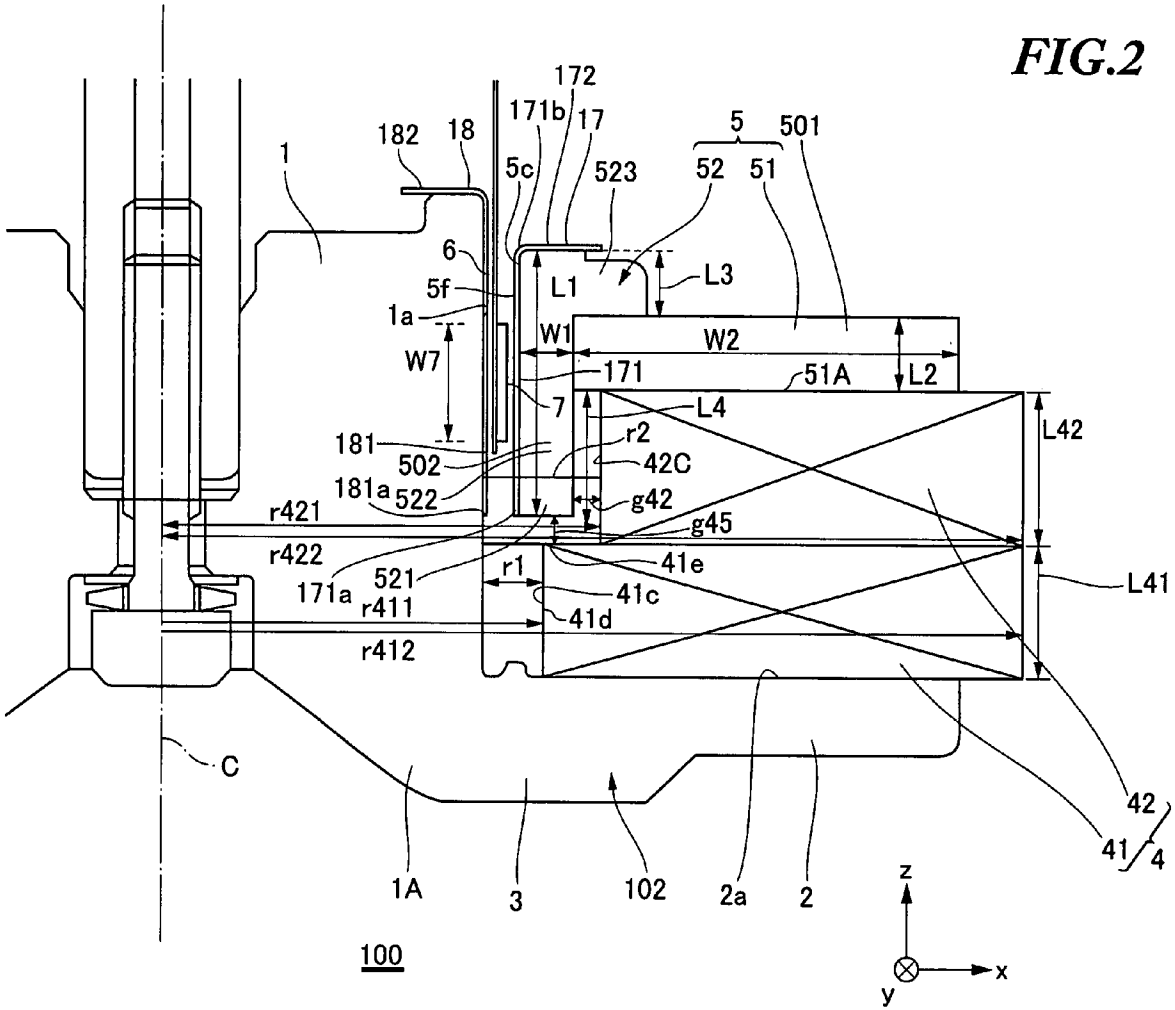
FIG. 2 is an enlarged sectional view showing an area surrounding a magnetic circuit of the speaker device illustrated in FIG. 1.

FIG. 1 is across sectional view showing a speaker device formed according to one embodiment of the present invention. FIG. 2 is an enlarged sectional view showing an area around a magnetic circuit of the speaker device shown in FIG. 1. As shown in FIGS. 1 and 2, the speaker device 100 of the present embodiment comprises: a yoke 3 integrally formed with a center pole 1 uprightly standing in a generally central position of the speaker device 100 and a bottom yoke 2 extending in the radial direction from the base end 1A of the center pole 1; an annular magnet 4 which is a permanent magnet formed coaxially around the center pole 1; and a top plate 5 formed coaxially around the center pole 1 and disposed over the magnet 4, thus forming an outer diameter side flux applying section. In this way, the yoke 3, the magnet 4 and the center pole 1 together form a magnetic circuit 102 which generates flux 101 (FIG. 1 shows only the left side flux 101). Moreover, the magnetic circuit 102 has formed a magnetic gap g between the outer peripheral surface 1*a* of the center pole 1 and the inner circumferential surface 5*c* of the top plate 5. The top plate 5 of the present embodiment includes a first piece 51 and a second piece 52. The magnet 4 of the present embodiment includes a first magnet piece 41 and a second magnet piece 42.

Moreover, as shown in FIGS. 1 and 2, the speaker device 100 is so formed that the voice coil 7 wound around the voice coil bobbin 6 is disposed within the magnetic gap g. The voice coil bobbin 6 is freely vibratably supported by the frame 9 in the axial direction (the center axis direction of the center pole 1 (z-axis direction)), by virtue of a damper member 8 such as a spider member. The central portion of the diaphragm 10 is fixed in the vicinity of the upper end of the voice coil bobbin 6, while the outer edge portion of the diaphragm 10 is connected to the inner circumferential portion of the frame 9 through an edge member 12. Further, on one side of the top plate 5 facing the diaphragm 10 there is provided a heat dissipating member which can be used to fix the top plate 5 and release a heat of the top plate 5.

The yoke 3 is disposed in the central portion of the speaker device 100. In practice, the yoke 3 of the present embodiment is formed of a magnetic material such as iron. In more detail, the yoke 3 includes a cylindrical center pole 1 uprightly standing in the central portion of the speaker device 100, and a bottom yoke 2 which is a radially enlarged portion extending in the radial direction from the base end of the yoke 3 facing away from the diaphragm 10. On the outer periphery of the bottom yoke 2 facing the diaphragm 10, there is formed a flat portion 2*a* mounting the magnet 4. In this way, the annular magnet 4 having a rectangular cross section in the radial direction can be mounted on the flat portion 2*a*, being coaxial with the center pole 1. Then, the top plate 5 is mounted on one side of the magnet 4 facing the diaphragm 10 in a coaxial relation with the center pole 1.

As described above, the magnet 4 of the present embodiment has the first magnet piece 41 and the second magnet piece 42 which are arranged one above the other in a manner such that the directions of their magnetic moments become equal to each other. Here, the first magnet piece 41 is an equivalent to an embodiment of the first annular magnet of the present invention, the second magnet piece 42 is an equivalent to an embodiment of the second annular magnet of the present invention, with the inner diameter r411 of the first magnet piece 41 being larger than the inner diameter r421 of the second magnet piece 42. Further, in the present embodiment, the outer diameter r412 of the first magnet piece 41 and the outer diameter r422 of the second magnet piece 42 are set at approximately the same length. Namely, a distance r1 between the outer peripheral surface 1*a* of the center pole 1 and the inner circumferential surface 41*c* of the first magnet piece 41 is smaller than a distance between the outer peripheral surface 1*a* of the center pole 1 and the inner circumferential surface 42*c* of the second magnet piece 42. Moreover, the length L41 of the first magnet piece 41 in the axial direction (z-axis direction) is set to be at approximately the same length as the second magnet piece 42 in the axial direction.

The top plate 5 is formed of a magnetic material such as iron. In fact, the top plate 5 has a cylindrical bent portion 502 bending from a radial direction rectangular section portion 501 having a surface 51A facing the second annular magnet 42, and facing between the inner circumferential surface 42*c* of the second annular magnet 42 and the center pole 1, and separated a predetermined interval from the inner circumferential surface 42*c* of the second annular magnet 42. Then, among the bent portion 502 of the top plate 5, a part (an inner circumferential surface 5*c*) facing the magnetic gap g is formed (along the center axis c) into a width L1 larger than the winding width w7 of the voice coil 7. In practice, such a width L1 is set to be substantially equal to or larger than a vibration range of the voice coil bobbin 6.

A front end 521 of the bent portion 502 is disposed from the vicinity of a plate side corner portion 41*e* of an inner edge portion 41*d* of the first annular magnet 41, and located on the plate side by being separated a predetermined interval g45 from the corner portion 41*e*.

Figure 3A:
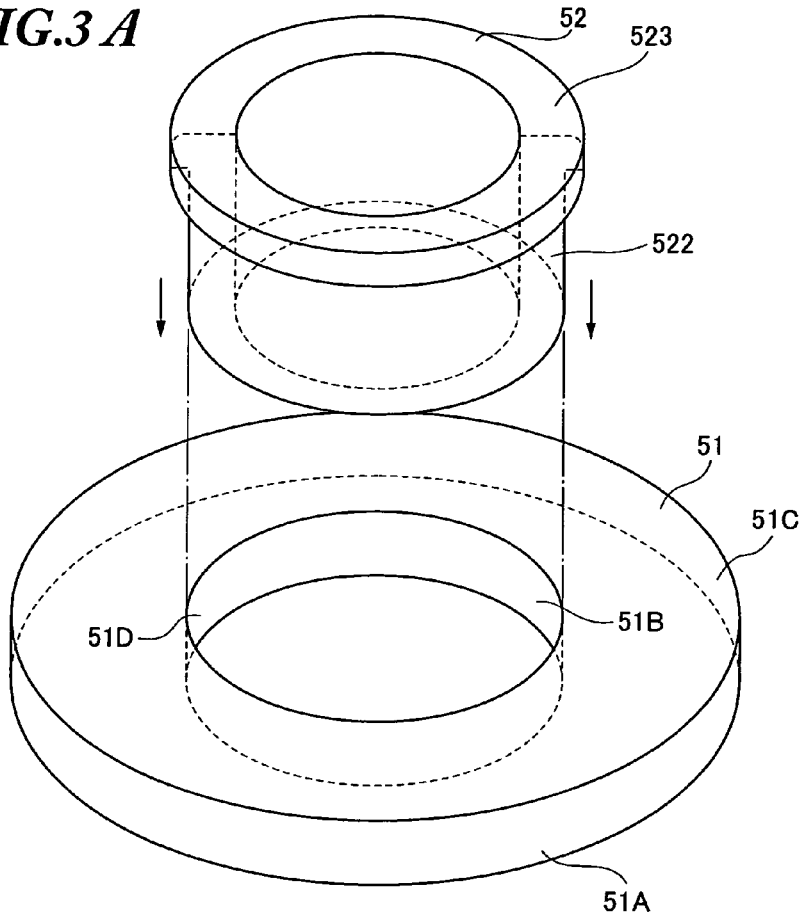
FIG. 3A is an exploded perspective view showing the top plate which has not been assembled and FIG. 3B is a perspective view showing the top plate which has been assembled.
Figure 3B:
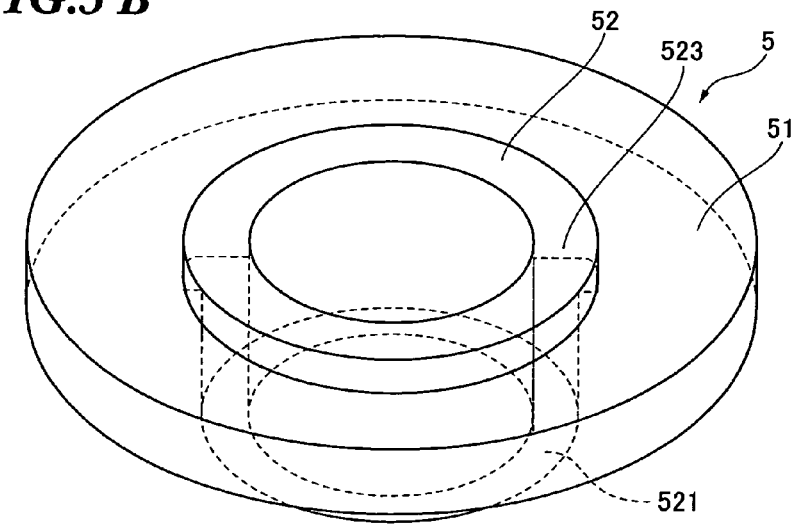

FIG. 3 is a view showing the top plate of the speaker device 100 illustrated in FIGS. 1 and 2. FIG. 3A is an exploded perspective view showing the top plate, and FIG. 3B is a perspective view showing the top plate which has been assembled. In the present embodiment, as shown in FIGS. 1 to 3A and 3B, the top plate 5 has a first piece 51 and a second piece 52 which can be assembled together to form a desired plate. In the following, description will be given to explain each element forming the top plate.

As shown, the first piece 51 has a large diameter hole 51B formed in the center thereof, thereby forming a ring-shaped thin plate. The first piece 51 has an outer peripheral surface 51A facing the second magnet piece 42. Further, the first piece 51 is so formed that its radial direction section has a long and narrow rectangular shape, has a uniform thickness in the axial direction, thereby forming a radially extending circular plate. In more detail, the first piece 51 has a radial direction section which is so formed that its radial direction size W2 is larger than its axial direction size L The second piece 52 includes a cylindrical portion 522 extending in the axial direction and an engaging portion 523. In more detail, the cylindrical portion 522 has a large diameter and a small thickness, presenting a long and narrow rectangular shape in its cross section, thereby forming a cylinder member having a uniform thickness W1 in the radial direction and extending in the axial direction. As shown in FIG. 2, the second piece 52 has, on its inner circumferential surface, a magnetic gap facing surface 5*f* facing the magnetic gap g. In the radial direction cross section, the magnetic gap facing surface 5*f* has an axial direction size L1 which is larger than the radial direction size W1. The engaging portion 523 is bent from the outer circumferential surface of the cylindrical portion 522 towards the first piece 51, forming an annular protruding portion which can be engaged with the first piece 51, in a manner shown in FIGS. 3*a* and 3*b*.

By virtue of the inner circumferential surface of the through hole 51B of the first piece 51 and its vibration side large surface 51C, a corner 51D is formed corresponding to the inner circumference of the diaphragm 10, serving as an engaging portion for an engagement between the first piece 51 and the engaging portion 523 of the second piece 52. As shown in FIG. 3B, the two engaging portions are combined with each other so as to effect a mutual positioning. By virtue of the corner portion 51D, the annular inner edge upper surface portion of the first piece 51 is tightly fit (in the axial direction) against the underside of the engaging portion 523 of the second piece 52, and the inner circumferential surface of the first piece 51 is tightly fit (in the radial direction) with the outer circumferential surface of the second piece 52. Here, a first extension length L3 of the second piece 52 extending beyond the first piece 51 towards the diaphragm 10 is set to be shorter than a second extension length L4 of the second piece 52 extending away from the diaphragm 10.

As described above, as shown in FIGS. 1 to 3, the first piece 51 and the second piece 52 of the present embodiment are arranged in a manner such that the annular inner edge upper surface portion of the first piece 51 is tightly fit (in the axial direction) against the underside of the engaging portion 523 of the second piece 52, and the inner circumferential surface of the first piece 51 is tightly fit (in the radial direction) with the outer circumferential surface of the second piece 52. However, it is usually difficult to perform a processing to tightly fit together the two cylindrical members in the radial direction. On the other hand, the first piece 51 and the second piece 52 are also allowed not to be tightly fit to each other in the radial direction, but allowed to be combined with each other magnetically. Preferably, the first piece 51 and the second piece 52 are combined with each other through surfaces having magnetically large areas. For this reason, it is preferable that both the contacting surfaces in the axial direction and the contacting surfaces in the radial direction are tightly fit to each other. Alternatively, when some gaps are formed between the two pieces, it is preferable that these gaps are filled with a magnetic material.

Here, the so-called magnetic combination is an equivalent to an arrangement in which one material is flux-transferably combined with another material. For example, it is possible for one material to get an indirect contact with another material through an adhesive layer having a magnetism.

Here, the first piece 51 and the second piece 52 are bonded to each other through an adhesive agent (not shown) applied between the inner circumferential surface of the first piece 51 and the outer circumferential surface of the second piece 52. The first piece 51 directly mounted on the magnet 4 is bonded to the magnet 4 through an adhesive agent. Further, the heat dissipating member 11 made of a non-magnetic material such as aluminum or the like having an acceptable thermal conductivity is disposed on the top plate 5 close to the diaphragm 10. Preferably, such a heat dissipating member 11 is a non-magnetic material so that it will not disturb the magnetic circuit.

A part of the inner portion of the frame 9 extends to an open end of the first piece 51, while the dissipating member 11 is formed in a manner such that its contacting portion 11*a* formed at the front end thereof is in contact with the open end of the first piece 51. The contacting portion 11*a* is formed with a through hole in the axial direction, while a screw hole is formed in the first piece 51 at a position corresponding to the through hole. The heat dissipating member 11 is fixed by fixing a bolt 14 in the screw hole on the first piece 51. In fact, the heat dissipating member 11 can serve as heat dissipating means for releasing the heat of the top plate 5 and for fixing the top plate 5 on the magnet 4.

Between the outer peripheral surface 1*a* of the center pole 1 and the inner circumferential surface 5*c* of the top plate 5, there is formed a magnetic gap g along the entire circumference. In detail, such a magnetic gap g is formed over the outer peripheral surface of the center pole 1, extending along the outer peripheral surface of the center pole 1 in the axial direction. Namely, the magnetic gap g is formed in a cylindrical shape. A voice coil 7 is wound around the outer peripheral surface of an elongated thin thickness cylindrical voice coil bobbin 6 and located within the magnetic gap g. In practice, the voice coil bobbin 6 is supported through one end thereof by the frame 9 through the spider 8 which is a damper member.

In this way, the voice coil 7 can be provided in a manner such that it can vibrate within the magnetic gap g in the axial direction of the center pole 1. In detail, the foregoing end of the voice coil bobbin 6 is connected with the inner circumference of the so-called cone type diaphragm. The frame 9 has a cylindrical shape and tapered to some extent. The bottom of the frame 9 is formed with a screw hole for a bolt to insert therethrough. A fixing plate for supporting the yoke 3 from the backside thereof is fixed on the frame 9.

Moreover, as shown in FIG. 1, a center pole piece 15 having substantially the same diameter as the center pole 1 is fixed on the center pole 1 within the voice coil bobbin 6, by virtue of a bolt 16.

For example, when a signal current containing a high frequency component is inputted into the voice coil 7 and when the high frequency component of about 100 Hz or more is inputted from the voice coil 7, an AC flux will be generated. Such an AC flux will be collected in the vicinity of the magnetic gap G, particularly in the center pole 1 and the top plate 5 near the magnetic gap G. Generally, materials forming the center pole 1 and the top plate 5 have, as their magnetic property, a non-linear property such as a hysteresis loop (minor loop). For this reason, an eddy current generated by an AC flux will receive an influence based on the minor loop, causing a distortion in an electric current flowing into the voice coil and thus bringing about a distortion in a reproduced sound. In particular, with regard to a speaker device containing a long plate having the above-described structure, a distortion based on an AC flux is relatively large.

In view of the above, the speaker device 100*a* of the present embodiment is fabricated in a manner such that on a part (inner circumferential surface 5*c*) of the bent portion 502 of the top plate 5 facing the magnetic gap g and/or on the outer peripheral surface 1*a* of the center pole 1, there is formed a short circuit ring consisting of a non-magnetic and electrically conductive material. In the present embodiment, short circuit rings consisting of a non-magnetic material are provided in both of the above positions, so that a distortion caused by an AC flux is greatly reduced.

Figure 4A:
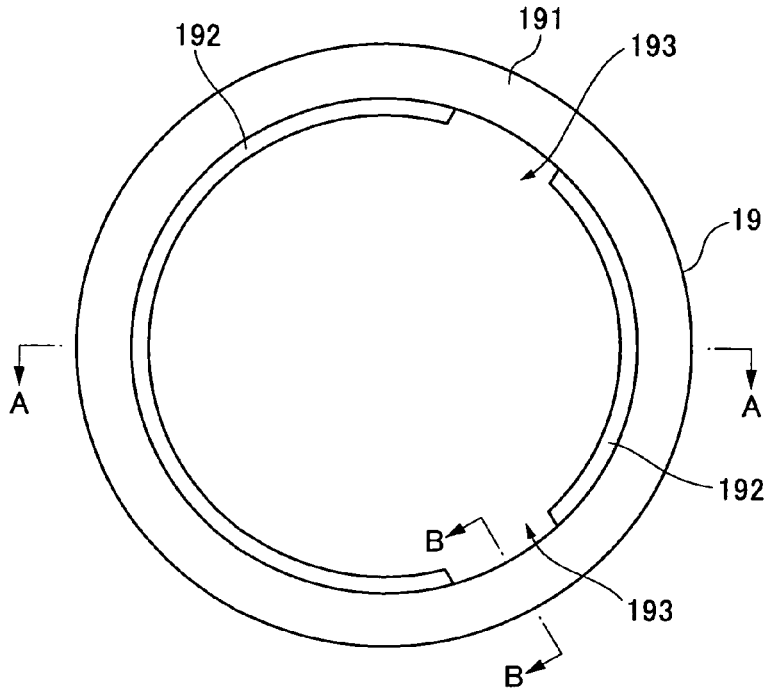
FIG. 4A is a top plan view of the annular member.
Figure 4B:
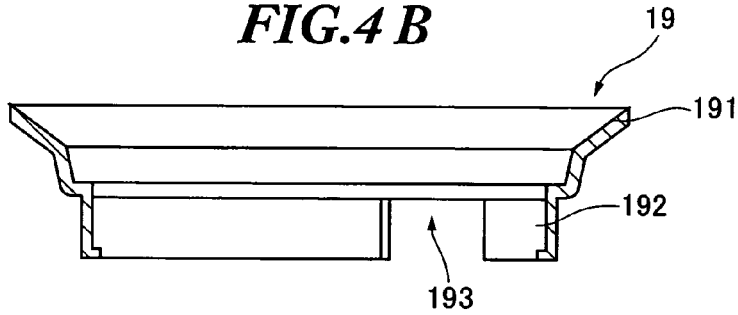
FIG. 4B is a sectional view taken along A-A line cutting through the annular member shown in FIG. 4A.
Figure 4C:
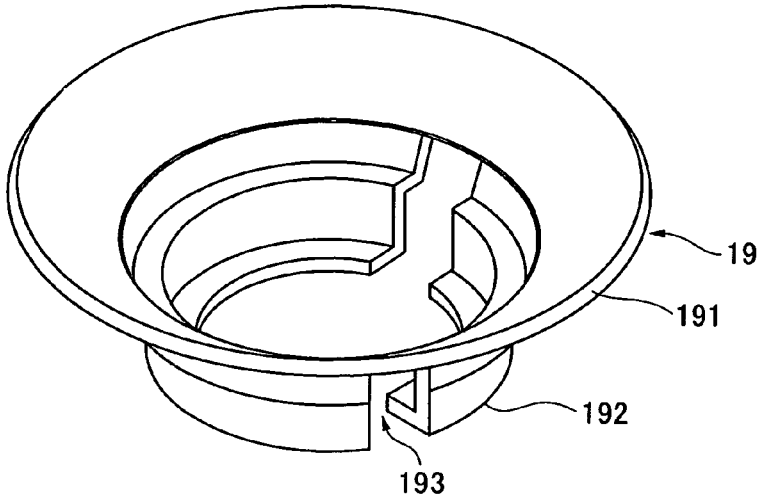
FIG. 4C is a perspective view showing the annular member.
Figure 5:
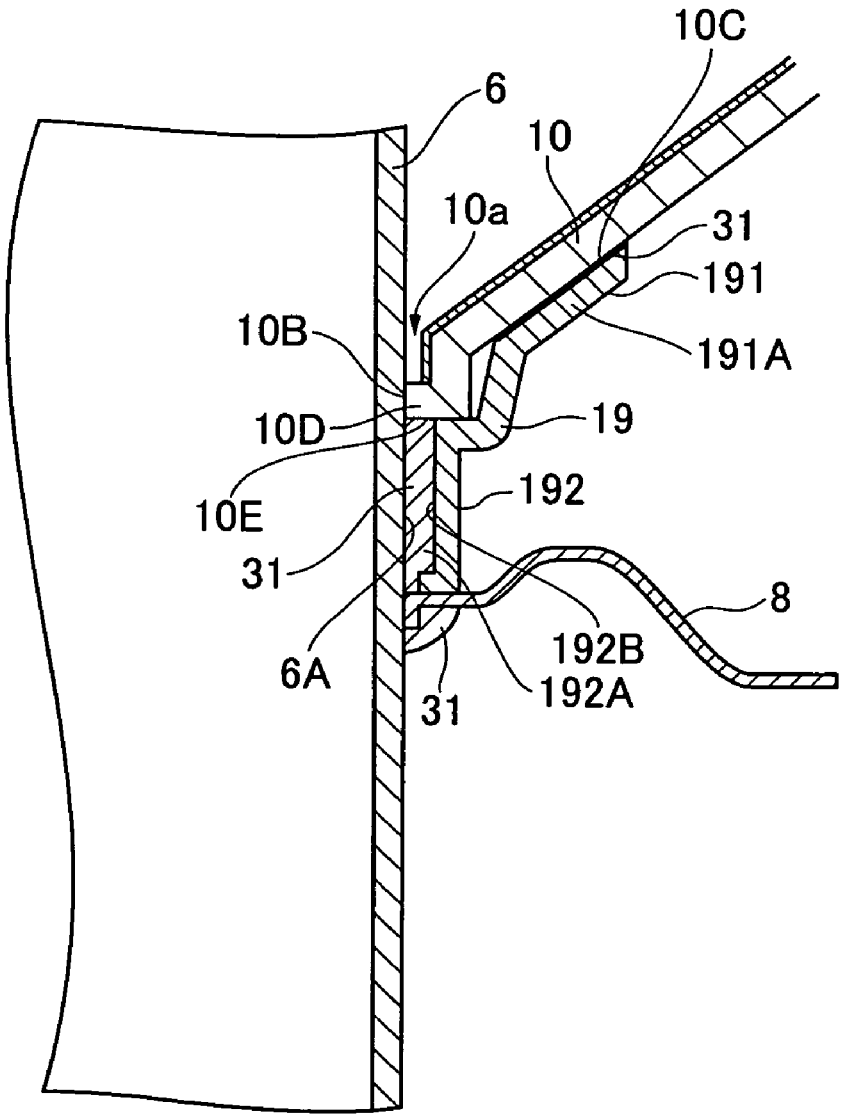
FIG. 5 is an enlarged sectional view showing an area near the annular member of the speaker device illustrated in FIG. 1.
Figure 6:
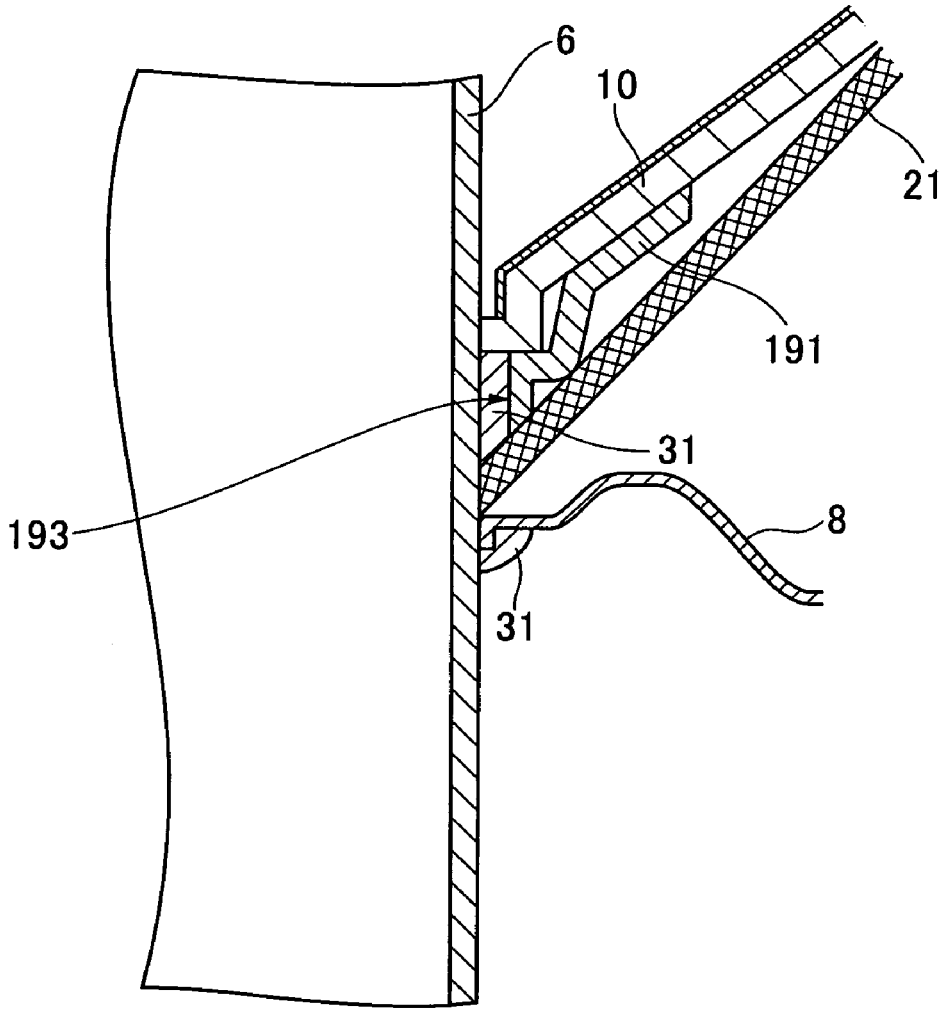
FIG. 6 is an enlarged sectional view showing an area near a notch portion of the annular member illustrated in FIG. 5.

FIG. 4 provides views showing an annular member for use in reinforcing the speaker device 100 shown in FIG. 1. FIG. 4A is a top plan view showing the annular member, FIG. 4B is a sectional view taken along A-A line of the annular member shown in FIG. 4A. FIG. 4C is a perspective view showing the annular member. FIG. 5 is an enlarged sectional view showing an area near the annular member of the speaker device 100 shown in FIG. 1. FIG. 6 is also an enlarged sectional view showing an area near a notch of the annular member shown in FIG. 5.

The speaker device 100 according to the present embodiment generates a strong driving force by virtue of the magnetic circuit 102 having the above described structure. To cope with the strong driving force, a diaphragm reinforcing annular member (a holder) is provided in a neck portion of a generally conical diaphragm 10, thereby improving a strength of the neck portion of the diaphragm 10. In more detail, as shown in FIGS. 1 to 6, the speaker device 100 comprises: a generally conical diaphragm formed with an opening in a generally central portion thereof; a voice coil bobbin 6 fixed in an inner circumferential portion of the diaphragm 10; and a diaphragm reinforcing annular member 19 disposed in a fixing section (the neck portion of the diaphragm 10) which is provided for fixing together the diaphragm 10 and the voice coil bobbin 6.

As shown in FIGS. 4A to 4C, the annular member 19 has a diaphragm reinforcing portion 191 and a cylindrical portion 192. The diaphragm reinforcing portion 191 and the cylindrical portion 192 are formed of a resin material or the like and integrally molded together. The diaphragm reinforcing portion 191 has an inclined surface 191A facing an inclined surface 10C of the diaphragm 10 located close to an inner circumferential surface 10B of the opening of the diaphragm 10, and fixed on the inclined surface 10C of the diaphragm 10 by virtue of an adhesive agent 31. The cylindrical portion 192 has a generally cylindrical shape as well as a liquid holding portion 192A formed between the voice coil bobbin 6 and the annular member 19 and filled with an adhesive agent 31. The diaphragm 10 and the annular member 19 fixed on the diaphragm 10 through the diaphragm reinforcing portion 191 are fixed on the voice coil bobbin 6 by virtue of the adhesive agent 31 contained within the liquid holding portion 192A.

The diaphragm 10 of the present embodiment is formed with a bent portion 10D bending from the inclined surface 10C of the diaphragm 10 towards the inner side of the opening of the diaphragm. Then, as shown in FIG. 5, an adhesive agent 31 is introduced into an internal space (equivalent to the liquid hold portion 192A) defined by an outer peripheral surface 6A of the voice bobbin 6, an inner surface of the cylindrical portion 192, and an outer surface 10E of the bent portion 10D of the diaphragm 10.

As shown in FIGS. 1 and 6, the speaker device 100 has a lead wire 21 or the like. One end of the lead wire 21 is electrically connected to a terminal section 22 disposed on the frame 9, while the other end of the lead wire 21 is electrically connected to the voice coil 7. Further, as shown in FIGS. 1 and 6, the cylindrical portion 192 of the annular member 19 is formed with a notch 193. The lead wire 21 is inserted through the notch 193 so as to be electrically connected to the voice coil 7 in a manner shown in FIG. 6. In fact, the notch 193 formed in this way makes it easy to electrically connect a lead wire to the voice coil 7. Further, it is also possible to provide a plurality of such notches 193 (corresponding to the number of lead wires) in the annular member 19. In the present embodiment, along the entire circumference of the annular member 19, there are formed several notches 193 each having a predetermined opening angle (about 25 degrees), with one notch separated from another at a predetermined angle (for example, about 85 degrees).

[Speaker Device Manufacturing Method]

Figure 7:
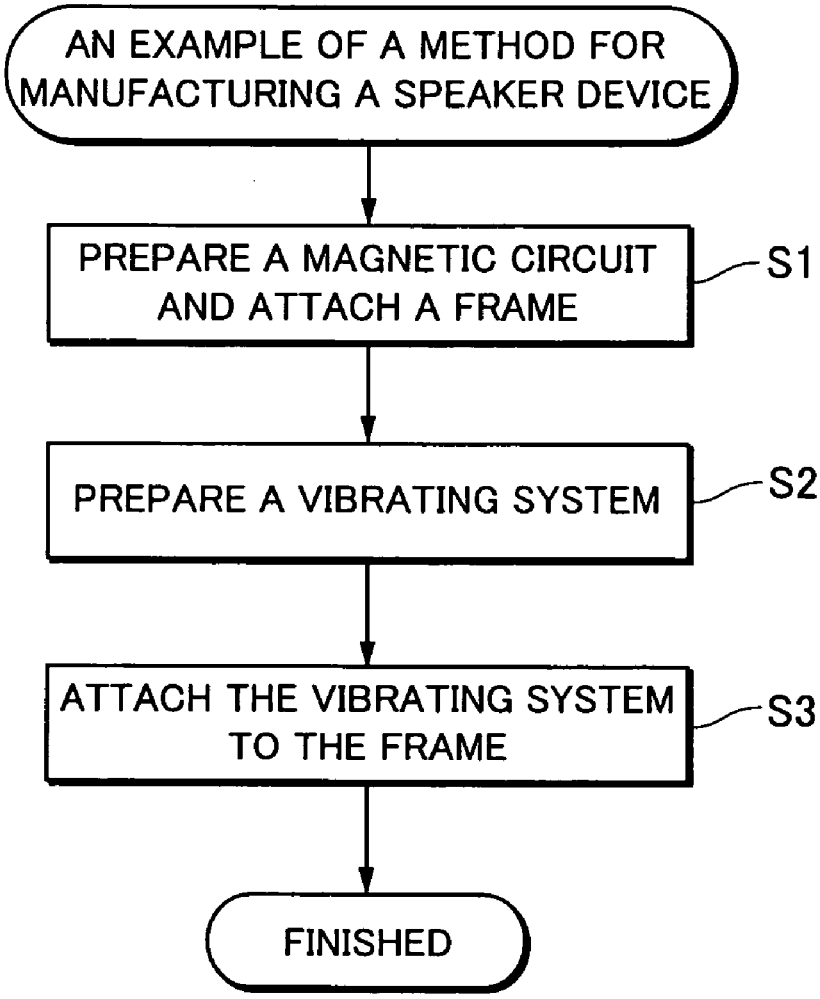
FIG. 7 is a flow chart showing a process for manufacturing the speaker device illustrated in FIG. 1.
Figure 8:
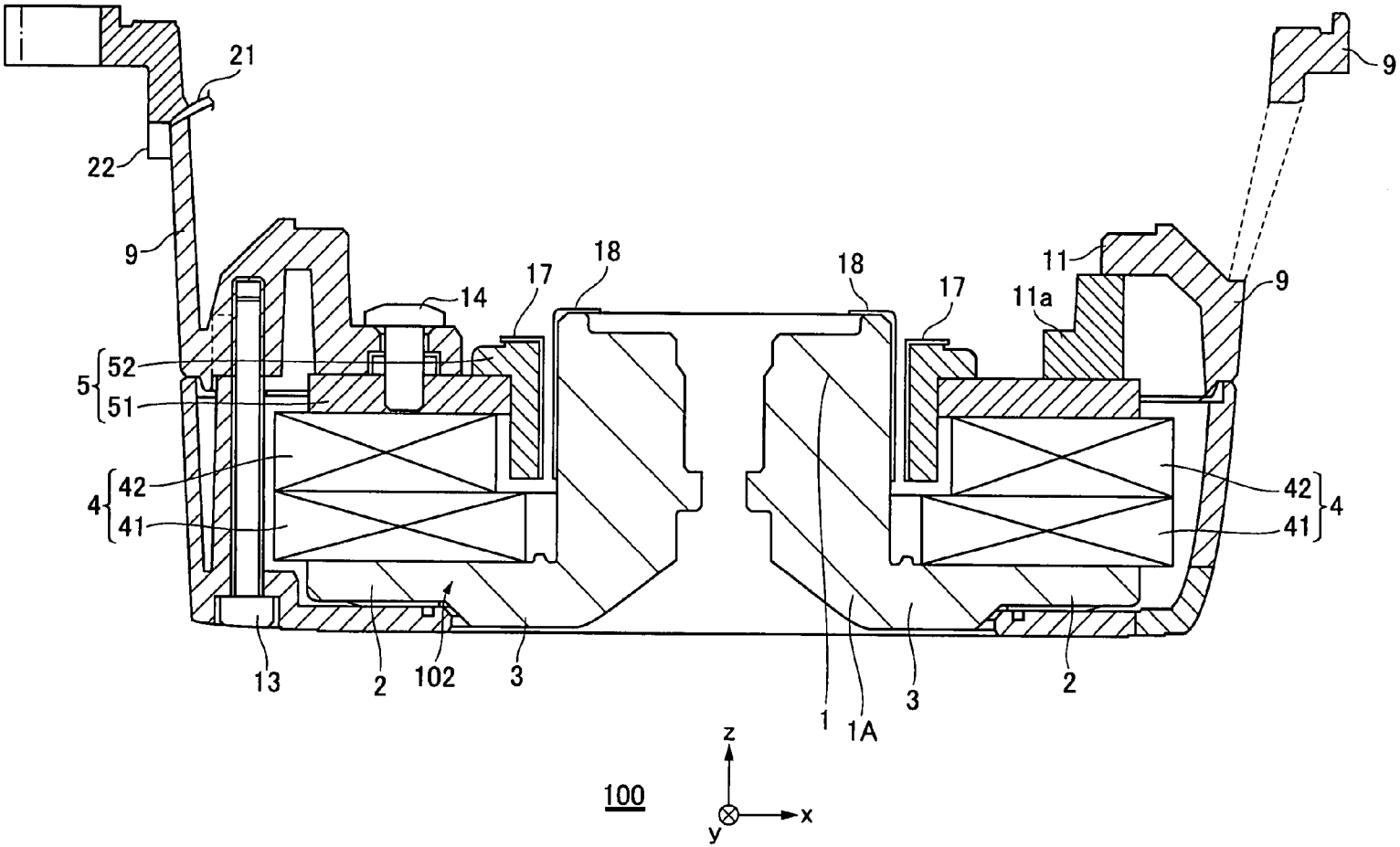
FIG. 8 is a cross sectional view showing a magnetic circuit of the speaker device illustrated in FIG. 1.

FIG. 7 is a flow chart showing a method of manufacturing the speaker device illustrated in FIG. 1. FIG. 8 is a sectional view showing a magnetic circuit of the speaker device illustrated in FIG. 1. In the following, description will be given to explain a detailed example of a method for manufacturing a speaker device, with reference to the accompanying drawings. First, a magnetic circuit 102 is fabricated and attached to the frame 9 (step S1). In detail, as shown in FIG. 8, a magnet 4 is fixed on the bottom yoke 2 of the yoke 3, while a top plate 5 is disposed on the magnet 4. In this way, a magnetic circuit 102 is formed and fixed to the frame 9.

Figure 9:
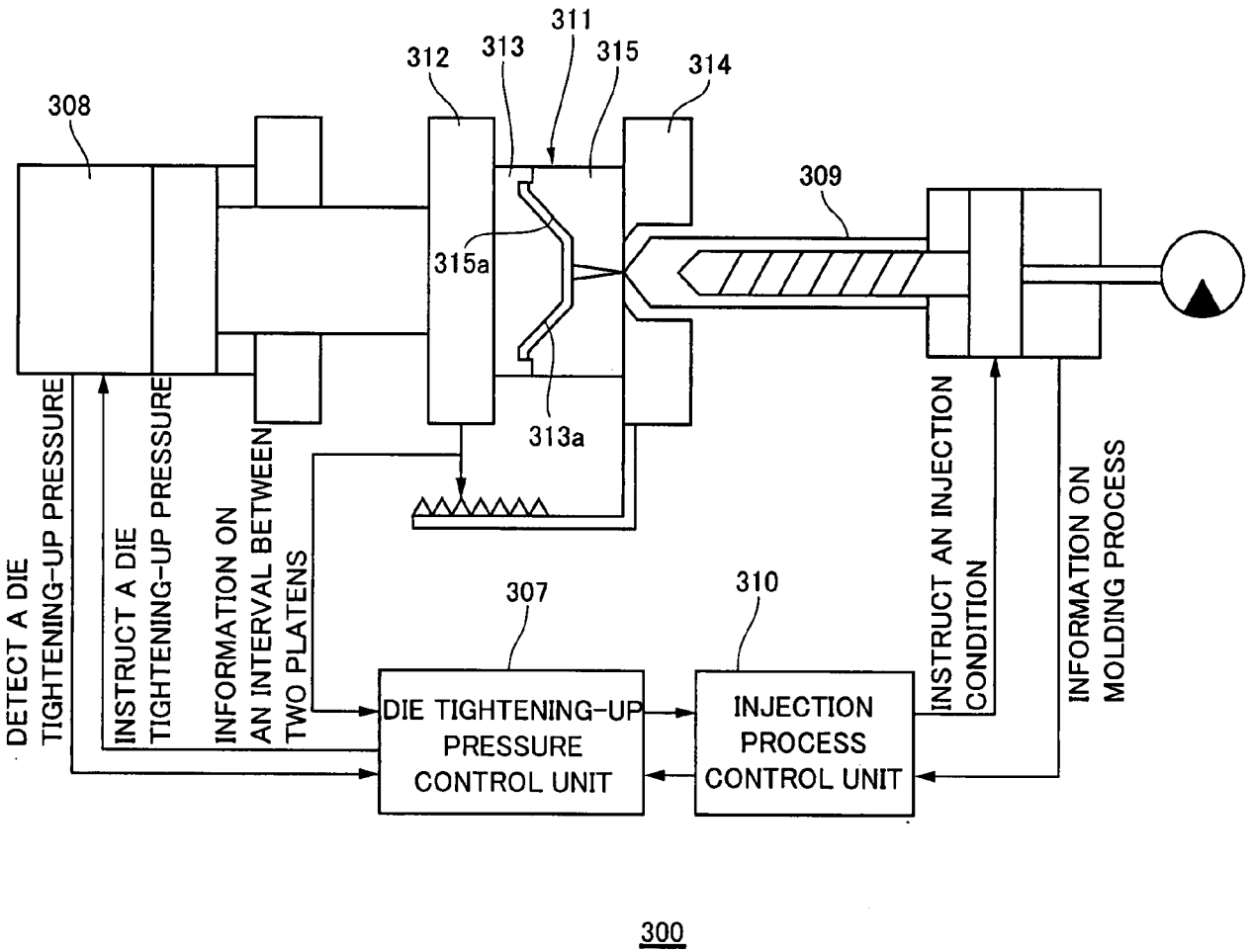
FIG. 9 is an explanatory view showing an apparatus for use in manufacturing a conical diaphragm of the present invention.
Figure 10:
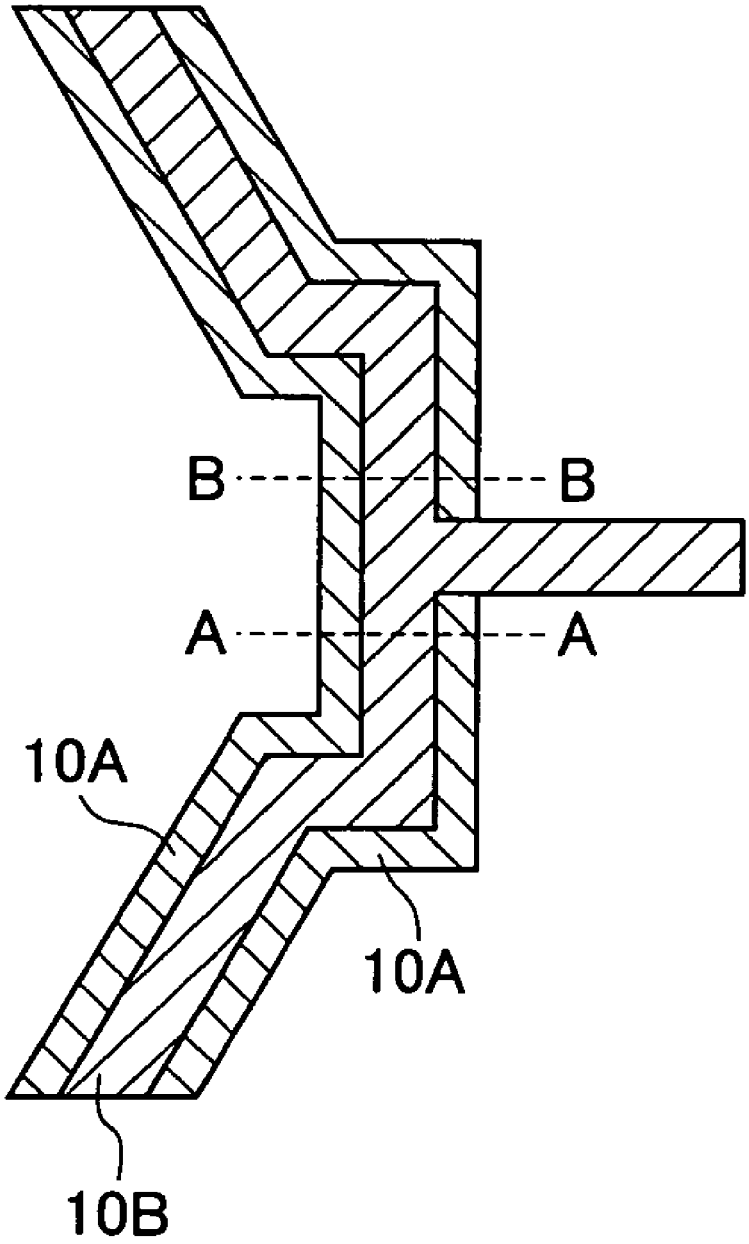
FIG. 10 is an explanatory view showing a conical diaphragm formed according to the present invention.
Figure 11:
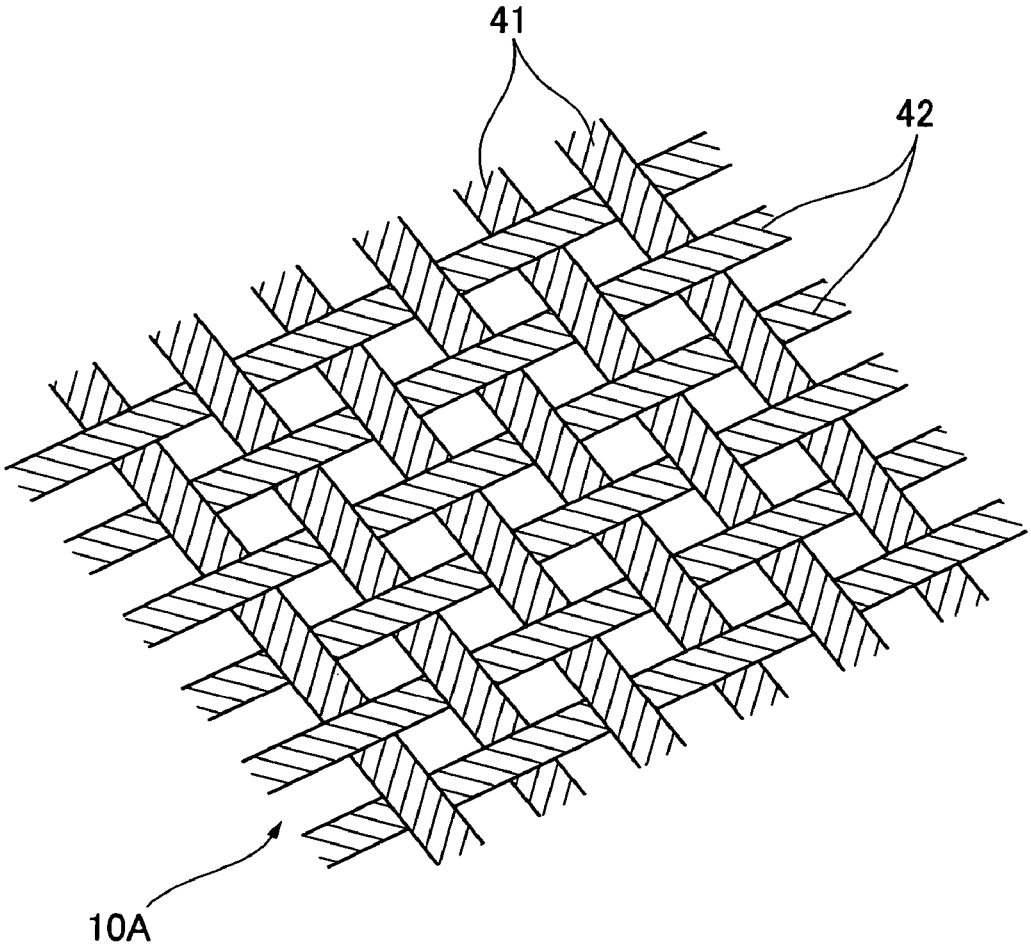
FIG. 11 is an explanatory view showing a detailed example of a material forming the diaphragm illustrated in FIG. 10.

Next, essential elements forming a vibrating system of the present invention are fabricated (step S2). FIG. 9 is an explanatory view showing an apparatus for manufacturing a conical diaphragm of the present invention. FIG. 10 is an explanatory sectional view showing the conical diaphragm of the present invention. FIG. 11 is an explanatory view showing a detailed example of a material forming the diaphragm illustrated in FIG. 10.

As shown in FIG. 10, the diaphragm 10 of the present embodiment has an integrally molded structure in which first diaphragm layers 10A and a second diaphragm layer 10B have been integrally molded together by means of injection molding. Here, each first diaphragm 10A can be formed of a fiber material which may be polyamide fiber, aramid fiber, carbon fiber, silk-containing fiber, or glass fiber. Further, as shown in FIG. 11, each first diaphragm layer 10A is formed by adopting a cloth fabricated by weaving a fiber 41 and a fiber 42 into two-axis woven (flat woven) structure. The second diaphragm layer 10B consists of a synthetic resin which is in tight contact with the first diaphragm layers 10A. As shown in FIG. 10, the diaphragm 10 of the present embodiment is formed by interposing the second diaphragm layer 10B between two first diaphragm layers 10A. At this time, the first diaphragm layer 10A on the front side is allowed to be made of a material which is different from a material for forming the first diaphragm layer 10A on the backside. For example, the first diaphragm layer 10A on the front side may be formed of a cloth material which is aramid fiber or silk fiber, while the first diaphragm layer 10A on the backside may be formed of a cloth material consisting of a glass fiber.

As shown in FIG. 9, a die 311 of a manufacturing apparatus 300 includes: a male die 313 having a conical convex portion 313*a* formed along the contour of the diaphragm 10; and a female die 315 having a conical concave portion 315*a* corresponding to the conical convex portion 313*a*. In the present embodiment, the male die 313 is held by a movable platen 312 so that it can operate as a movable die. The female die 315 is fixed on a platen 314 so that it can operate as a fixed die. A tightening-up pressure between the male die 313 and the female die 315 is controlled by a tightening-up cylinder 308 controlled by a die tightening-up pressure control unit 307. An emission hole 325 (gate) for injecting a resin is formed through the central portion of the female die 315, while an emission nozzle of an injection device 309 is inserted to aim at the foregoing emission hole 325 for injecting various injection materials such as a resin mixture or the like containing an olefin series resin such as PP (polypropylene) or the like as a main component and a foaming agent, an inorganic or organic filler as auxiliary components. The injection device 309 is controlled by an injection condition decided by an injection process control unit 310. Information on injection molding process is outputted from the injection device 309, thereby effecting a die tightening-up pressure control based on a die tightening-up pressure control unit 307, in response to the foregoing information and the information on the position of the movable platen 312.

FIG. 12 provides explanatory views showing a detailed example of a method for manufacturing a diaphragm using a manufacturing apparatus shown in FIG. 9. Accordingly, the following description will be given to explain a manufacturing method based on the manufacturing apparatus 300 having the above-described structure, with reference to FIG. 12. At first, the die 311 (313,315) is opened as shown in FIG. 12A. Then, the first diaphragm layers 10A are arranged in a manner shown in FIG. 12B. Here, the fixing of the first diaphragm layers 10A on the respective dies 313,315 may be effected by using a predetermined technique such as sheet positioning pin, sheet pressing means, and vacuum suction.

Figure 12A:
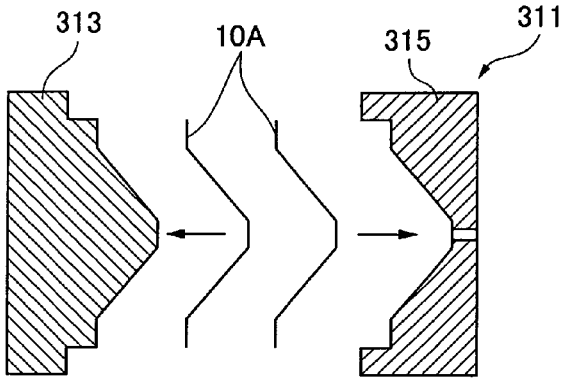
FIG. 12 provides views showing a process for manufacturing a diaphragm, using the manufacturing apparatus illustrated in FIG. 9.
Figure 12D:
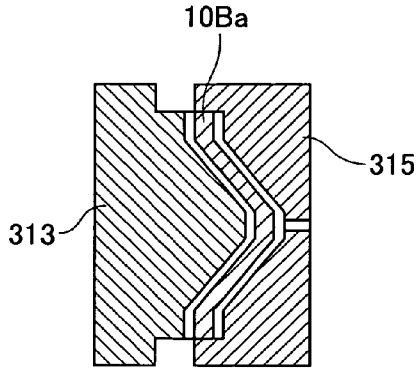
Figure 12B:
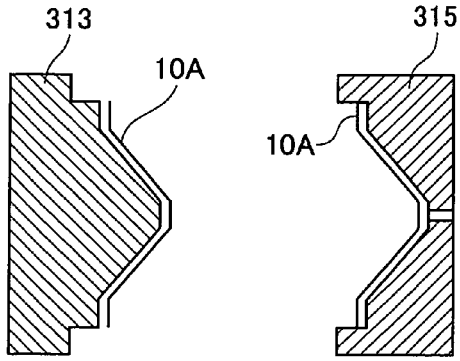
Figure 12E:
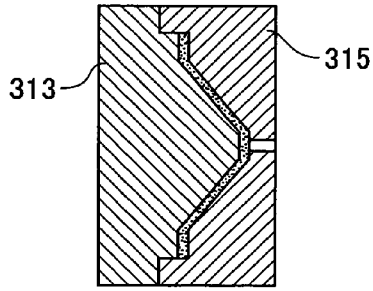
Figure 12C:
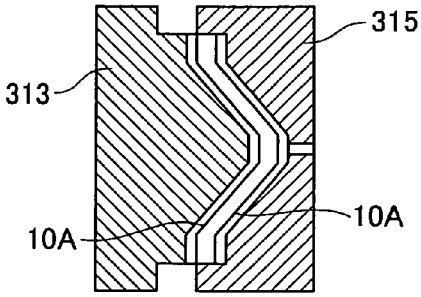
Figure 12F:
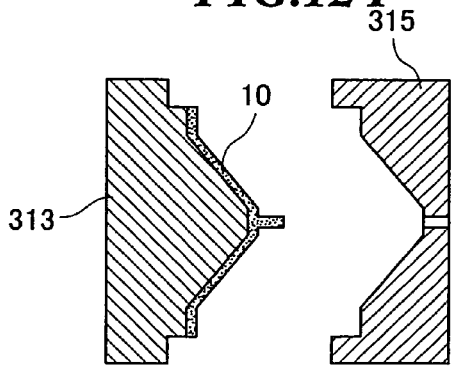

Next, as shown in FIG. 12C, after the die 311 is closed, an internal space formed within the die 311 is filled with an injection material 10Ba for forming the second diaphragm 10B. Such an injection material 10Ba is a mixture containing an olefin series resin as a main component and a foaming agent, an inorganic or organic filler as auxiliary components. As shown in FIG. 12E, when filling the foregoing internal space with the injection material 10Ba, it is possible to uniformly fill the cavity (the foregoing internal space) with the injection material 10Ba by performing a pressing which slightly tightens up the two dies 313 and 315. Subsequently, the two dies 313 and 315 are separated from each other a little to cause a foaming in an un-solidified layer of the resin contained in the cavity. Then, upon completing the foaming process, the two dies 313 and 315 are separated from each other again in a manner shown in FIG. 12F, there by obtaining the diaphragm 10 having a multi-layered structure in which the second diaphragm layer 10B having a foamed structure is interposed between the two first diaphragm layers 10A. Here, although the present embodiment shows that the diaphragm 10 has a three-layer foamed structure, this should not form any limitation to the present invention. In fact, it is also possible to form an injection molded structure rather than the foregoing foamed structure, or a structure in which a first diaphragm layer 10A is formed on either the front side or the backside of the diaphragm 10. In addition, it is further possible for the diaphragm 10 to have a simplified structure formed of a single one piece member.

Then, as shown in FIG. 10, the injection molded product is cylindrically cut in the vicinity of its central portion along an A-A line and a B-B line shown in the drawing, so as to remove a gate trace formed due to an injection outlet of the die, thereby producing a diaphragm 10 having a predetermined configuration.

Next, the annular member 19 is fabricated. In detail, a cavity formed within the die and having a shape corresponding to the annular member is filled with a molding material such as a resin, thereby producing the annular member 19 (as shown in FIGS. 1, 5 and 6) according to one embodiment of the present invention.

Figure 13A:
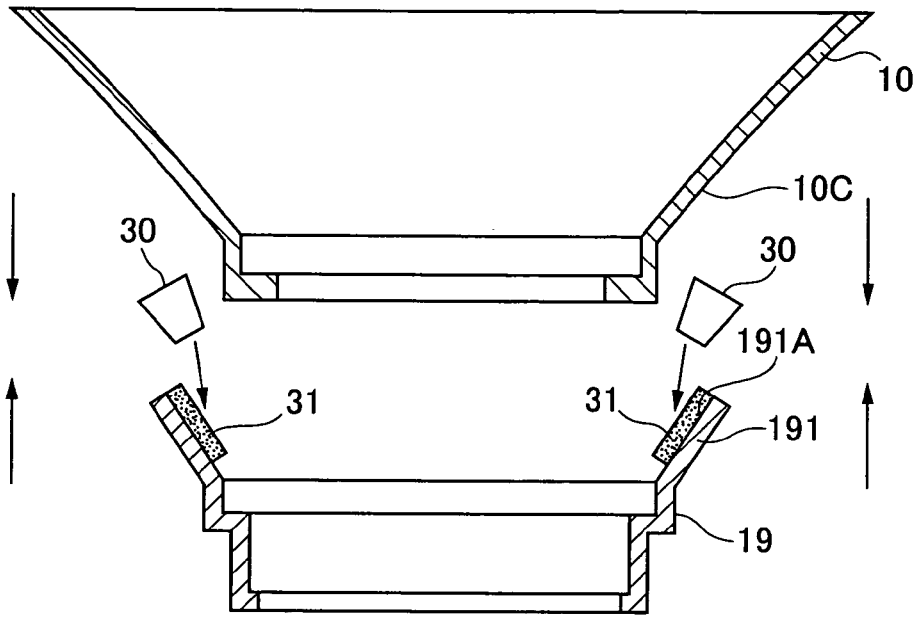
FIG. 13A is a sectional view showing a state in which the diaphragm and the annular member have not been assembled together.
Figure 13B:
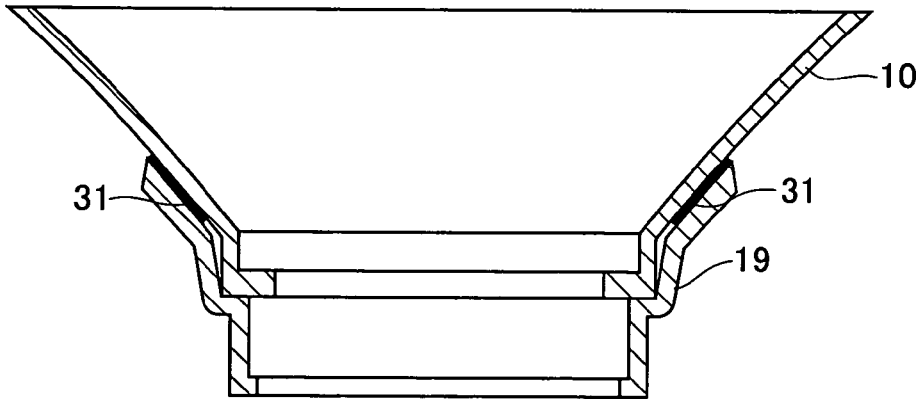
FIG. 13B is a sectional view showing a state in which the diaphragm and the annular member have been assembled together.

FIG. 13 provides views showing a process of assembling together the diaphragm and the annular member. FIG. 13A is a sectional view showing a state in which an assembling operation has not been completed, while FIG. 13B is sectional view showing a state in which the assembling operation has been completed. Next, as shown in FIGS. 13A and 13B, the diaphragm 10 is arranged so that its backside faces the annular member 19. Then, an adhesive applying device 30 is used to apply an adhesive agent to an inclined surface 10C of the diaphragm 10 as well as to an inclined surface 191A formed on the diaphragm reinforcing portion 191 of the annular member 19, so that the diaphragm 10 and the annular member 19 may be fixed to each other.

Figure 14A:
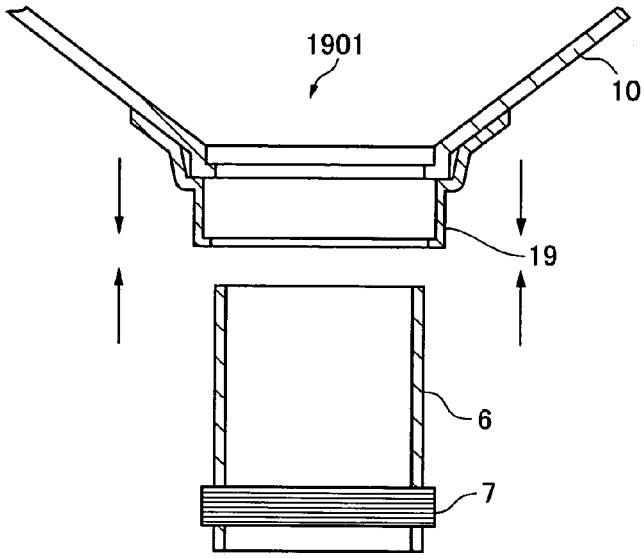
FIG. 14A is an explanatory view showing a state in which the diaphragm 10, the annular member 19 and the voice coil bobbin 6 have not been assembled together.
Figure 14B:
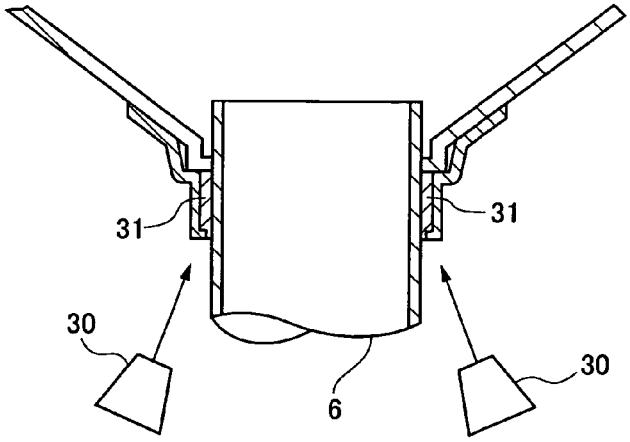
FIG. 14B is an explanatory view showing how an adhesive agent is applied.
Figure 14C:
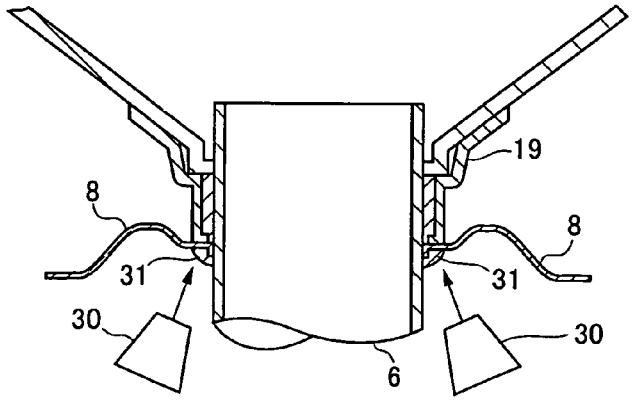
FIG. 14C is an explanatory view showing how a damper member is attached to the voice coil bobbin.

FIG. 14 provides views showing a detailed example of a process for assembling a vibration system show in FIG. 13. FIG. 14A is an explanatory view showing a state before the diaphragm 10, the annular member 19 and the voice coil bobbin 6 are assembled together. FIG. 14B is an explanatory view showing a process of applying an adhesive agent. FIG. 14C is an explanatory view showing a process of attaching a damper member.

Next, as shown in FIG. 14, the voice coil bobbin 6 wound around by the voice coil 7, as well as the diaphragm 10 and the annular member 19 fixed with each by virtue of an adhesive agent 31, are arranged in a manner such that the voice coil bobbin 6 can be engaged into the diaphragm 10 and the opening 1901 of the annular member 19, as shown in FIG. 14A. Then, as shown in FIG. 14B, the applying device 30 is used to apply the adhesive agent 31 to the liquid holding portion 192A of the annular member 19. At this time, as shown in FIG. 6, a bonding process is carried out under a condition in which each lead wire 21 connected to the voice coil has been inserted through a notch 193. Further, under a condition in which the diaphragm 10 and the annular member 19 as well as the voice coil bobbin 6 are arranged in a manner shown in FIG. 14B, the adhesive agent 31 is applied so that the liquid holding portion 192A can be easily filled with the adhesive agent 31. Moreover, since the adhesive agent can also be applied through the notch 193, it is allowed to more easily fill the liquid holding portion 192A with the adhesive agent 31. Subsequently, as shown in FIG. 14C, the damper member 8 is bonded to the bottom of the annular member 19 by virtue of the adhesive agent 31. Then, after a predetermined time has passed, the adhesive agent 31 solidifies so that the diaphragm 10, the annular member 19, the voice-coil bobbin 6, and the damper member 8 are fixed in a desired manner, thereby producing a desired vibrating system for use in a speaker device.

Next, as shown in FIG. 7, the foregoing vibration system is attached to the frame 9 (step S3). Then, the outer edge of the damper member 8 connected with the voice coil bobbin 6 is fixed to the frame 9 by virtue of an adhesive agent, in a manner such that the voice coil 7 is positioned within the magnetic gap g of the magnetic circuit 102. Afterwards, an edge member 12 is attached to the outer circumferential portion of the diaphragm 10 and then fixed to the outer circumferential portion of the frame 9 by virtue of an adhesive agent, thereby obtaining the speaker device 100.

As described above, the speaker device 100 of the present embodiment comprises a generally conical diaphragm 10 formed with an opening in a generally central position thereof, a voice coil bobbin 6 fixed in the inner circumferential portion of the opening of the diaphragm 10, and a diaphragm reinforcing annular member 19 disposed in a fixing section fixing together the diaphragm 10 and the voice coil bobbin 6. This annular member 19 is arranged to face an inclined surface of the diaphragm 10 near the inner circumferential portion thereof, has a diaphragm reinforcing portion 191 formed with an inclined surface and fixed on the foregoing inclined surface of the diaphragm 10 by virtue of an adhesive agent, also has a cylindrical portion 192 formed with a liquid holding portion 192A located between the voice coil bobbin 6 and the annular member 19 and possible to be filled with the adhesive agent 31. In this way, it is possible to ensure a higher strength near the fixing section fixing together the conical diaphragm and the voice coil bobbin (corresponding to the neck portion of the diaphragm) than a conventional speaker device. Further, since it is possible to obtain a relatively large strength near the neck portion of the diaphragm, it is possible to reduce an undesired dividing vibration of the diaphragm.

In particular, even when using an injection molded diaphragm such as PP (polypropylene resin) diaphragm or a diaphragm having a low rigidity, the provision of the annular member 19 around the neck portion of the diaphragm 10 makes it possible to easily improve the strength of the neck portion of the diaphragm 10.

Moreover, since the annular member 19 fixed to the diaphragm 10 through the diaphragm reinforcing portion 191 thereof is fixed around the voice coil bobbin 6 through an adhesive agent 31 applied in the liquid holding portion 192A of the cylindrical portion 192 of the annular member 19, it is possible to easily manufacture the speaker device of the present invention using a simplified manufacturing process.

Moreover, the annular member 19 is formed with the notches 193, while the lead wires 21 are inserted through the notches 193, so that the lead wires 21 can be electrically connected to the voice coil 7. In this way, since the diaphragm 10 is not formed with any notches which are otherwise needed in the prior art, it is possible to prevent a lowering of a strength of a diaphragm.

In a conventional speaker device, once a notch is formed in a diaphragm, there will be a distortion in the diaphragm, thus causing a deterioration in the sound quality of a reproduced sound. Different from the conventional speaker device, the speaker device 100 of the present invention is equipped with an annular member 19 in the neck portion of the conical diaphragm 10, thus avoiding the formation of any notch in the diaphragm 10, there preventing a deterioration in a reproduced sound.

Besides, the diaphragm 10 is formed with a bent portion 10D bending from an inclined surface of the diaphragm 10 towards the inner side of the opening of the diaphragm, while an adhesive agent 31 is applied to an internal space (liquid holding portion 192A) defined by the voice coil bobbin 6, the cylindrical portion 192 of the annular member 19 and the bent portion 10D of the diaphragm 10, thereby making it easy to fix together the voice coil bobbin 6, the annular member 19, and the diaphragm 10.

However, the above-described embodiment should not form any limitation to the present invention.

Figure 15:
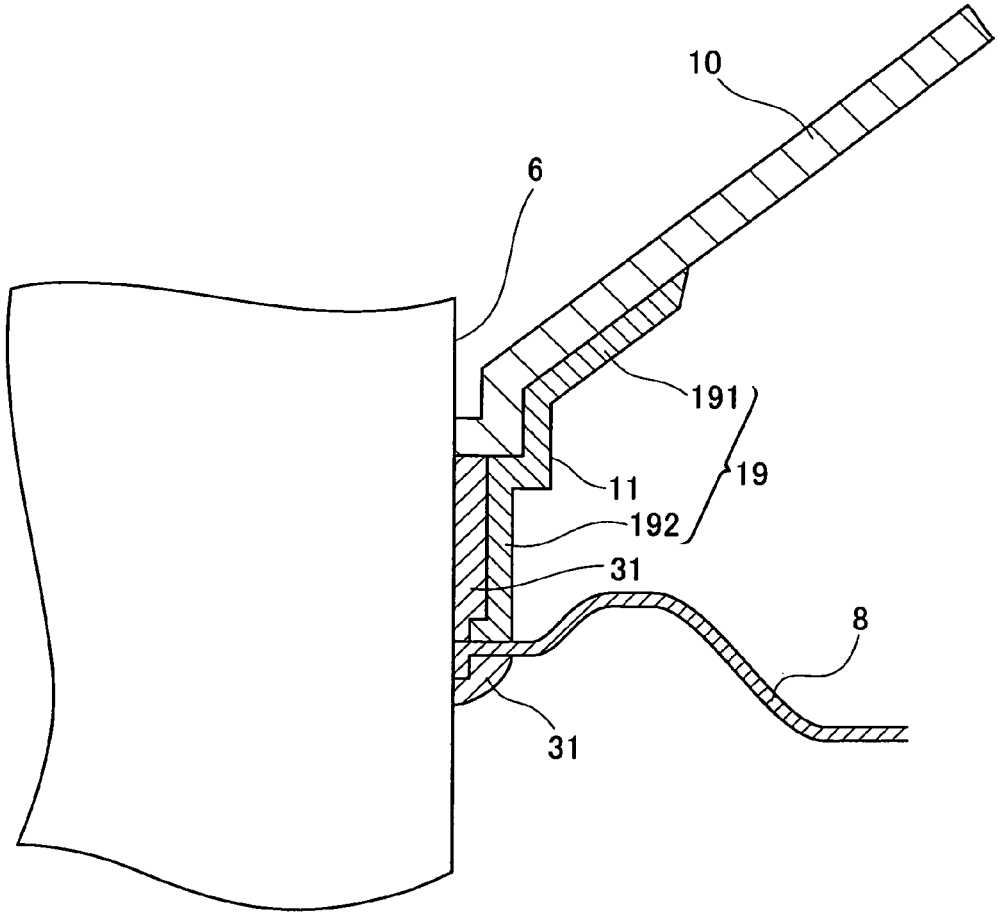
FIG. 15 is an explanatory view showing an annular member for use in a speaker device, which is formed according to another embodiment of the present invention.

For example, although the above-described embodiment has adopted a diaphragm formed by an injection foaming molding, this should not form any limitation to the present invention. In fact, it is also possible to use a diaphragm formed of single one material, or various other types of diaphragms. Besides, although the above-described embodiment has adopted a diaphragm which is conical in its shape, it is also possible to use a diaphragm which is elliptical or flat in its configuration. In addition, although the above-described embodiment has shown that an internal space or a gap is formed between the diaphragm reinforcing portion 191 of the annular member 19 on one hand and the diaphragm 10 on the other, it is also possible for the diaphragm reinforcing portion 191 to tightly fit on the diaphragm 10 without forming any gap therebetween, in a manner shown in FIG. 15.

Moreover, although the above-described embodiment has shown that an inclined adhesion surface is formed in a circular configuration between the neck portion of the diaphragm 10 on one hand and the diaphragm reinforcing portion 191 of the annular member 19 on the other, this should not form any limitation to the present invention. In fact, it is also possible for the diaphragm reinforcing portion 191 to be formed into any desired shape in response to a vibrating condition of the diaphragm 10. Preferably, the diaphragm reinforcing portion 191 is formed into any desired shape in response to an adhesion area and an adhesion surface configuration of the neck portion of the diaphragm 10, as well as the type of a material forming the diaphragm. In this way, it is possible to further reduce a distortion in a high-pitched sound (near a high-pitched sound reproduction critical frequency based on a vibration diameter).

As described above, the speaker device of the present invention comprises: a generally conical diaphragm 10 having an opening 10A formed in a generally central position the diaphragm; a voice coil bobbin 6 fixed in the inner circumferential portion of the foregoing opening of the diaphragm; and a diaphragm reinforcing annular member 19 disposed near a fixing section fixing together the diaphragm 10 and the voice coil bobbin 6. The annular member 19 includes, in the form of an integrally molded body, a diaphragm reinforcing portion 191 having an inclined surface 191A which faces an inclined surface 10C of the diaphragm 10 close to the inner circumferential portion thereof and is fixed to the inclined surface 10C of the diaphragm 10 by virtue of an adhesive agent 31, and a cylindrical portion 192 having a liquid holding portion 192A which is formed between the voice coil bobbin 6 and the annular member 19 and is filled with the adhesive agent 31. In this way, it is possible for the speaker device of the present invention to ensure a higher strength than a conventional speaker device in an area (corresponding to a neck portion of the diaphragm) near the fixing section fixing together the generally conical diaphragm and the voice coil bobbin, using the above-described simple structure.

As described above, since it is possible for the speaker device of the present invention to ensure a relatively large strength in an area near the neck portion of the diaphragm, it becomes possible to reduce an undesired dividing vibration in the diaphragm.

Moreover, even if the speaker device of the present invention adopts an injection molded diaphragm, it is still possible to improve the strength of the neck portion using the above-described simple structure.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A speaker device comprising:

a generally conical diaphragm having an opening formed in a generally central position of the diaphragm;

a voice coil bobbin fixed in an inner circumferential portion of the opening of the diaphragm; and a diaphragm reinforcing annular member disposed near a fixing section fixing together the diaphragm and the voice coil bobbin, wherein the diaphragm includes a bent portion bending from an inclined surface of the diaphragm towards an inner side of the opening of the diaphragm, and the voice coil bobbin is fixed to an inner circumferential surface of the bent portion, the annular member includes, in the form of an integrally formed body, a diaphragm reinforcing portion having an inclined surface which contacts the inclined surface of the diaphragm close to the inner circumferential portion thereof and is fixed to the inclined surface of the diaphragm by an adhesive agent, and a cylindrical portion forming a liquid holding portion and filled with the adhesive agent, the liquid holding portion is formed by a gap defined by the voice coil bobbin, the cylindrical portion, and the bent portion, and the voice coil bobbin, the cylindrical portion, and the bent portion are affixed together by virtue of the adhesive agent contained in the liquid holding portion.

2. The speaker device according to claim 1, further comprising:

a lead wire for supplying an electric signal, and a voice coil wound around the voice coil bobbin, wherein the cylindrical portion of the annular member has a notch formed thereon, and the lead wire is inserted through the notch and electrically connected to the voice coil.

3. The speaker device awarding to claim 1, wherein said diaphragm is formed by integrally molding together a first diaphragm layer consisting of at least a cloth and a second diaphragm layer consisting of a synthetic resin which is in tight contact with the first diaphragm layer, by means of an injection molding.

4. The speaker device according to claim 3, wherein said diaphragm is formed by integrally molding together the first diaphragm layer consisting of a cloth, a third diaphragm layer consisting of a cloth, and the second diaphragm layer which is disposed between the first diaphragm layer and the second diaphragm layer, by means of an injection molding.

* * * * *